US005522444A

United States Patent [19]

Liu

[11] Patent Number: 5,522,444

[45] Date of Patent: Jun. 4, 1996

[54] POSITIONING DEVICE FOR A HEADRAIL OF A VENETIAN BLIND

[76] Inventor: Tai-ping Liu, No. 15, Alley 8, Lane 3, Kuochi St., Lungching Hsiang, Taichung Hsien, Taiwan

[21] Appl. No.: 402,124

[22] Filed: Mar. 10, 1995

[51] Int. Cl.[6] ..... E06B 9/30

[52] U.S. Cl. ..... 160/178; 160/902; 248/262

[58] Field of Search ..... 160/178.1 R, 902, 160/168.1 R, 168.1 V, 173 R, 173 V, 909, 176.1 R, 176.1 V, 177 R, 177 V, 178.1 R, 178.1 V, 902, 900; 248/262

[56] References Cited

U.S. PATENT DOCUMENTS

| | | | |
|---|---|---|---|
| 2,673,608 | 3/1954 | Nelson | 160/178.1 R |
| 3,169,006 | 2/1965 | Lorentzen et al. | 248/262 |
| 3,425,480 | 2/1969 | Anderle et al. | 160/178.1 R |
| 4,802,644 | 2/1989 | Oskam | 160/902 X |
| 5,230,493 | 7/1993 | Luoto | 248/262 X |

*Primary Examiner*—Blair M. Johnson
*Attorney, Agent, or Firm*—Kirkpatrick & Lockhart

[57] ABSTRACT

A positioning device for a headrail of a venetian blind includes a pair of brackets each including a base plate mounted in a recess of the headrail near a distal end thereof, and at least one bore is defined through the base plate and aligning with a corresponding hole which is defined through a bottom portion of the headrail. Two side plates each are vertically formed on one side of the base plate, each abut on one side wall of the bottom portion, and each includes a top edge received in a groove which is defined in one hook portion which is formed on one associated side wall of the headrail. Each side of the base plate includes at least one supporting portion formed on an underside thereof and extending downwardly therefrom so as to rest on the bottom portion of the headrail, thereby defining a space between the base plate and the bottom portion. A positioning screw extends through the bore of the base plate and includes a head portion received in the space between the bore and the associated hole.

5 Claims, 1 Drawing Sheet

POSITIONING DEVICE FOR A HEADRAIL OF A VENETIAN BLIND

BACKGROUND OF THE INVENTION

1. Field of Invention

The present invention relates to a positioning device, and more particularly to a positioning device for a headrail of a venetian blind.

2. Related Prior Art

The closest prior art of a positioning device for a headrail of a venetian blind was disclosed in Applicant's own patent application U.S. Ser. No. 08/274,809, abandoned, filed on Jul. 14, 1994. However, by such an arrangement, the bracket is disposed out of the headrail and is not able to enhance or even blend in with the venetian blind, so easily detracting from the aesthetic quality of the venetian blind.

The present invention has arisen to mitigate and/or obviate the disadvantages of the conventional positioning device for a headrail of a venetian blind.

SUMMARY OF THE INVENTION

The primary objective of the present invention is to provide a hidden type of positioning device for a headrail of a venetian blind.

In accordance with one aspect of the present invention, there is provided a positioning device for a headrail of a venetian blind. The headrail is substantially U-shaped in section and comprises an elongated bottom portion including two opposite sides and two distal ends. Two holes each are defined through a corresponding one of the two distal ends of the bottom portion, and two side walls each are vertically formed on a corresponding one of the two sides of the bottom portion, thereby defining a recess therebetween. Each of the two side walls includes a hook portion formed on a top end thereof and extending inwardly and downwardly therefrom, thereby defining a slit therein.

The positioning device comprises a pair of brackets each mounted in the recess near a corresponding one of the two distal ends of the bottom portion. Each of the two brackets comprises a base plate mounted in the recess of the headrail and including two opposite sides and two free ends. At least one bore is defined through the base plate and aligns with a corresponding one of the two holes. Two side plates each are vertically formed on a corresponding one of the two sides of the base plate, each side plate abuts on a corresponding one of the two side walls, and each includes a top edge received in the slit of the associated hook portion. Each of the two sides of the base plate includes at least one supporting portion formed on an underside thereof and extending downwardly therefrom so as to rest on the bottom portion of the headrail, thereby defining a space between the base plate and the bottom portion. A positioning screw extends through the bore of the base plate and includes a head portion received in the space between the bore and the associated hole.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 1:
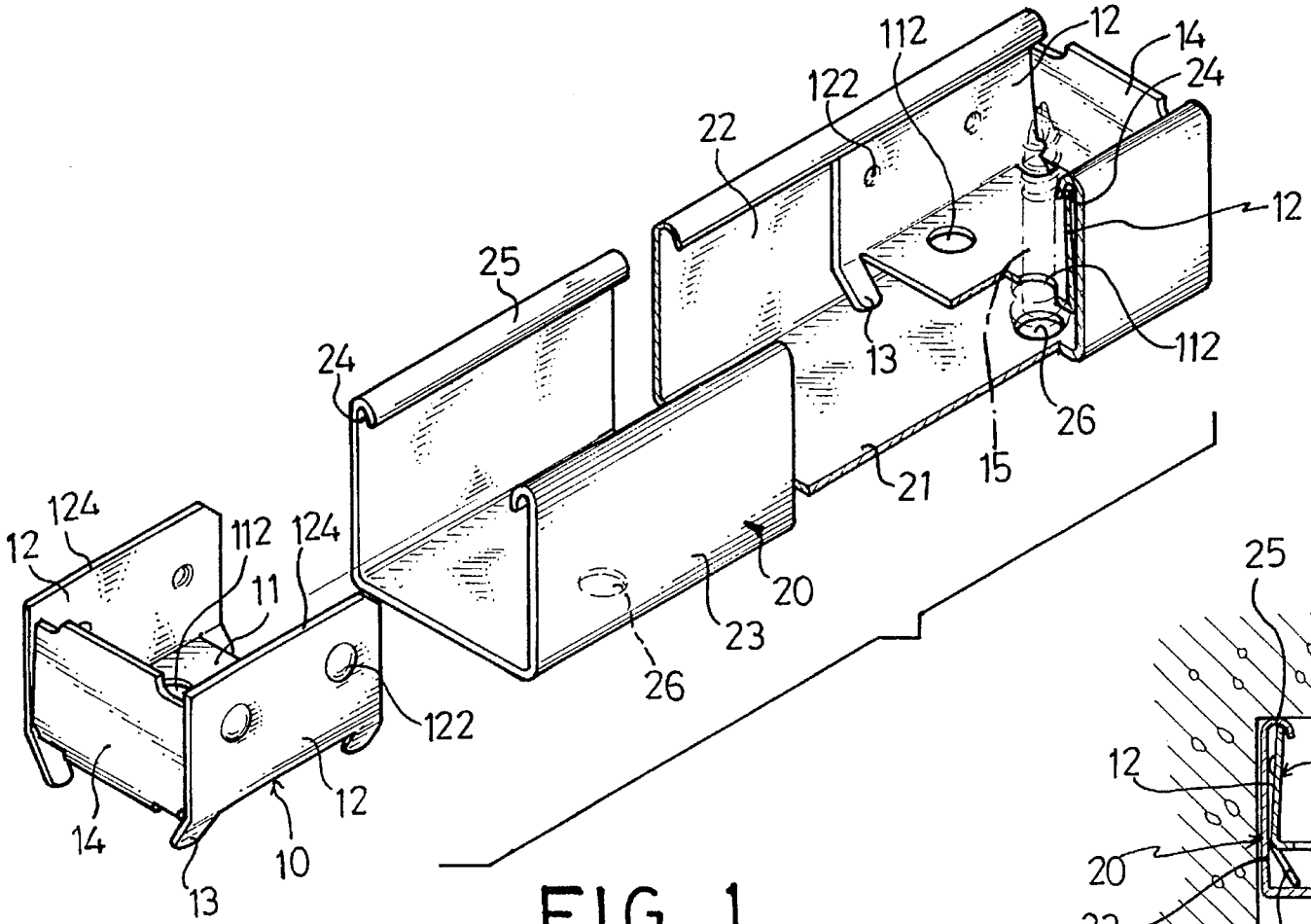
FIG. 1 is a partially cross-sectional perspective view of a positioning device for a headrail of a venetian blind in accordance with the present invention.
Figure 2:
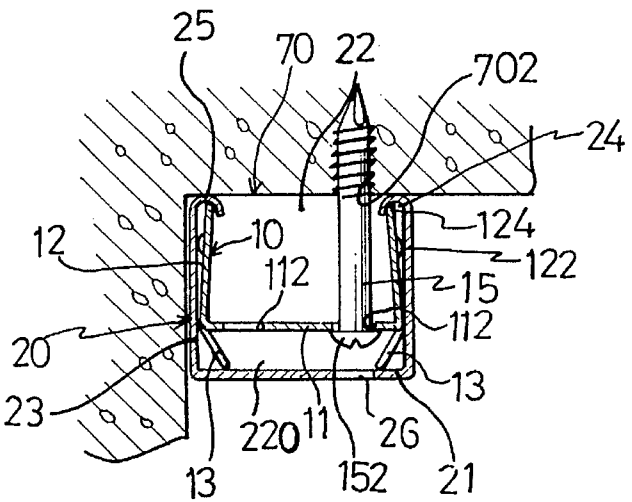
FIG. 2 is a cross-sectional assembly view of the positioning device with the headrail as shown in FIG. 1.

Referring to FIGS. 1 and 2, a positioning device in accordance with the present invention is provided for a headrail 20 of a venetian blind. The headrail 20 is substantially U-shaped in section and comprises an elongated bottom portion 21 including two opposite sides and two distal ends. Two holes 26 each are defined through a corresponding one of the two distal ends of the bottom portion 21 and align with each other, and two side walls 23 each are vertically formed on a corresponding one of the two sides of the bottom portion 21, thereby defining a recess 22 therebetween. Each of the two side walls 23 includes a hook portion 25 formed on a top end thereof and extending inwardly and downwardly therefrom, thereby defining a groove 24 therein.

The positioning device comprises a pair of brackets 10 each mounted in the recess 22 of the headrail 20 and each adjacent to a corresponding one of the two distal ends of the bottom portion 21. Each of the pair of brackets 10 comprises a base plate 11 mounted in the recess 22 of the headrail 20 and including two opposite sides and two free ends. Two bores 112 are defined through each of the two base plates 11, one of which aligns with a corresponding one of the two holes 26 of the bottom portion 21 of the headrail 20.

Two side plates 12 each are vertically formed on a corresponding one of the two sides of the base plate 11, each abut on a corresponding one of the two side walls 23, and each includes a top edge 124 received in the groove 24 of the associated hook portion 25. Preferably, each of the two side plates 12 includes two bosses 122 pressed therethrough on the associated the side wall 23. A shield plate 14 is vertically formed on one free end of the base plate 11 between the two side plates 12.

Each of the two sides of the base plate 11 includes two resilient supporting portions 13 formed on an underside thereof and extending downwardly therefrom so as to rest on the bottom portion 21 of the headrail 20, thereby defining a space 220 between the base plate 11 and the bottom portion 21. Preferably, the supporting portion 13 extends downwardly and inwardly in a tilting manner. Preferably, each of the brackets 10 is made essentially by means bending and pressing a metal plate so as to integrally form the base plate 11, the two side plates 12, the bosses 122, the shield plate 14, and the supporting portions 13.

A positioning screw 15 extends through the bore 112 of the base plate 11 and includes a head portion 152 received in the space 220 between the bore 112 and the associated hole 26. It is to be noted that the head portion 152 of the positioning screw 15 has a diameter greater than that of the hole 26 and the bore 112.

In operation, each of the two brackets 10 together with the associated positioning screw 15 is horizontally moved into the recess 22 of the headrail 20 with the bosses 122 of each of the two side plates 12 thereof urging against the associated side walls 23 and with each of the top edges 124 received in the associated groove 24, thereby securely positioning the bracket 10 in the headrail 20, while the supporting portions 13 rests on the bottom portion 21 such that the head portion 152 of each of the positioning screws is disposed between the associated space 220 between the base plate 11 and the bottom portion 21 and is located aligning with the associated hole 26.

Then, the headrail 20 together with the two brackets 10 is attached to a ceiling corner 70 (or a wall corner) with each of the positioning screws 15 being threaded into a recess 702 defined in the ceiling corner 70 by means of a tool such as a screw-driver through the associated hole 26, thereby securely fitted the headrail 20 together with the two brackets 10 to the ceiling corner 70. It is appreciated that, the usage of the bosses 122 facilitates the bracket 10 to move into the recess 22 of the headrail 20 and greatly reduces a friction exerted on the side plates 12 of the bracket 10 by the side walls 23.

Accordingly, by such an arrangement, a positioning device in accordance with the present invention has the following advantages and benefits:

(1) The bracket is entirely hidden in the recess of the headrail, thereby enhancing or even blending in with the venetian blind, so preventing detraction from the aesthetic quality of the venetian blind.

(2) The brackets are pre-fitted in the recess of the headrail without the need for separately packing the brackets and the headrail, thereby greatly reducing the process in packing and reducing waste in labor.

(3) The brackets are assembled and dismantled easily and rapidly by means rotating the positioning screw to be threaded into or unthreaded from the ceiling corner, thereby being suitable for a consumer's self-assembly (or "D.I.Y.").

(4) The bracket which is integrally formed with a simple construction is suitable for both the two distal ends of the headrail, thereby greatly decreasing producing cost.

It should be clear to those skilled in the art that further embodiments of the present invention may be made without departing from the teachings of the present invention.

I claim:

1. A positioning device for a headrail of a venetian blind, said headrail being substantially U-shaped in section and comprising an elongated bottom portion including two opposite sides and two distal ends, two holes each defined through a corresponding one of said two distal ends of said bottom portion, two side walls each vertically formed on a corresponding one of said two sides of said bottom portion, thereby defining a recess therebetween, each of said two side walls including a hook portion formed on a top end thereof and extending inwardly and downwardly therefrom, thereby defining a groove therein, said positioning device comprising a pair of brackets each mounted in said recess near a corresponding one of said two distal ends of said bottom portion, each of said pair of brackets comprising a base plate mounted in said recess of said headrail and including two opposite sides and two free ends, at least one bore defined through said base plate and aligning with a corresponding one of said two holes, two side plates each vertically formed on a corresponding one of said two sides of said base plate and each abutting on a corresponding one of said two side walls, each of said two side plates including a top edge received in said groove of associated said hook portion, each of said two sides of said base plate including at least one supporting portion formed on an underside thereof and extending downwardly therefrom so as to rest on said bottom portion of said headrail, thereby defining a space between said base plate and said bottom portion, a positioning screw extending through said bore of said base plate and including a head portion received in said space between said bore and associated said hole.

2. The positioning device in accordance with claim 1, wherein said head portion of said positioning screw has a diameter greater than that of said hole and said bore.

3. The positioning device in accordance with claim 1, further comprising a shield plate vertically formed on one free end of said base plate between said two side plates.

4. The positioning device in accordance with claim 1, wherein each of said two side plates includes at least one boss pressed therethrough on associated said side wall.

5. The positioning device in accordance with claim 1, wherein said supporting portion extends downwardly and inwardly in a tilting manner.

* * * * *

UNITED STATES PATENT AND TRADEMARK OFFICE

CERTIFICATE OF CORRECTION

PATENT NO. : 5,522,444
DATED : June 4, 1996
INVENTOR(S) : Tai-Ping Liu

It is certified that error appears in the above-indentified patent and that said Letters Patent is hereby corrected as shown below:

Col. 2, line 64, after "screws" add --15--.

Signed and Sealed this

Twenty-second Day of October, 1996

*Attest:*

BRUCE LEHMAN

*Attesting Officer*

*Commissioner of Patents and Trademarks*